United States Patent [19]

Zehler et al.

[11] Patent Number: 4,601,840

[45] Date of Patent: Jul. 22, 1986

[54] MIST LUBRICATION PROCESS

[75] Inventors: Eugene R. Zehler, Cincinnati; Clark J. Flake, Trenton, both of Ohio

[73] Assignee: National Distillers and Chemical Corp., New York, N.Y.

[21] Appl. No.: 747,462

[22] Filed: Jun. 21, 1985

[51] Int. Cl.[4] ..... C10M 107/20; C10M 107/32

[52] U.S. Cl. ..... 252/56 S; 252/15; 585/3; 585/12; 184/6.26; 184/109

[58] Field of Search ..... 252/56 S, 15; 585/12, 585/3; 184/6.26, 109

[56] References Cited

U.S. PATENT DOCUMENTS

| | | | |
|---|---|---|---|
| 3,098,042 | 7/1963 | Morucuy | 252/51.5 A |
| 3,510,425 | 5/1970 | Wilson | 252/56 R |
| 3,805,918 | 4/1974 | Altgelt et al. | 252/15 |
| 3,855,135 | 12/1974 | Newingham et al. | 252/56 R |
| 3,860,522 | 1/1975 | Fischer et al. | 252/56 S |

FOREIGN PATENT DOCUMENTS 1099450 1/1968 United Kingdom .

*Primary Examiner*—William R. Dixon, Jr.
*Assistant Examiner*—Cynthia A. Prezlock
*Attorney, Agent, or Firm*—Kenneth D. Tremain; Gerald A. Baracka

[57] ABSTRACT

An improved mist lubrication process whereby excellent lubrication and misting properties are obtained utilizing synthetic ester mist lubricants derived from specific polyol esters, trimellitate esters and dimer diesters and a mixture of polyisobutylene polymers having different molecular weights is provided.

14 Claims, No Drawings

MIST LUBRICATION PROCESS

BACKGROUND OF THE INVENTION

1. Field of the Invention

This invention relates to an improved mist lubrication process whereby excellent lubrication and misting properties are obtained utilizing synthetic ester mist lubricants derived from specific polyol esters, trimellitate esters and dimer diesters and a mixture of polyisobutylene polymers having different molecular weights.

2. Description of the Prior Art

Automatic lubrication using mist oils is well known and, for certain applications, recognized as the most effective and economical means of providing a controlled amount of lubricant to the point of lubrication. Mist oil lubrication is particularly useful when the point or area to be lubricated is not readily or safely accessible.

Oil mist systems are extensively utilized for lubrication of equipment used in steel processing operations and have been found to be a particularly effective means of lubrication for the roll bearings in hot strip mills resulting in more efficient lubricant utilization and prolonged bearing life. The extended bearing life is generally believed to be the result of (1) more uniform lubricant distribution, (2) lower bearing temperatures, and (3) elimination of contaminants—these latter two benefits being the direct result of the positive air flow associated with the application of the mist to the bearing.

In addition to having acceptable lubrication properties, the lubricants used in these systems must also have acceptable mist characteristics. High molecular weight polymers, such as polybutenes, polyisobutylenes, polyacrylates, and ethylene-propylene copolymers, are added to the base oil to develop proper mist characteristics. A general discussion of the effect of polymeric additives on mist properties is presented by T. D. Newingham in *Lubrication Engineering,* 33 (3), 128–132 (1977).

U.S. Pat. No. 3,510,425 discloses a mist lubrication process which uses mineral oil-based mist oils containing 0.05 to 3.5 weight percent of a polyester. Polyesters which are useful for the formulation of the mist oils have number average molecular weights from 80,000 to 150,000 and are derived from esters of acrylic or methacrylic acid and $C_{12-12}$ alkyl monohydric alcohols.

A process of lubrication utilizing mineral oil-based mist lubricants is disclosed in U.S. Pat. No. 3,855,135. Polymeric additives employed for the process of U.S. Pat. No. 3,855,135 have viscosity average molecular weights from 10,000 to 2,000,000 and are selected from polystyrene and polystyrene in admixture with a polyacrylate or polybutene. From 0.01 to 2 weight percent of the polymeric additive is added to the mineral oil to obtain acceptable mist characteristics.

A process of micro-fog lubrication utilizing mineral lubricating oils containing a minor proportion of a polymeric additive having a number average molecular weight of at least 10,000 is also disclosed in British patent specification 1,099,450. The polymeric additives are products which are normally used as VI improvers in motor oils and especially those having low shear stability. Copolymers of vinyl acetate, alkyl fumarate esters and N-vinyl pyrrolidone having number average molecular weights of at least 100,000 are indicated to be particularly useful additives for the process.

U.S. Pat. No. 3,805,918 discloses a process whereby undesirable stray mist in mist oil lubrication is reduced to low levels by using mist oils containing from 0.001 to 2 weight percent of an oil-soluble polyolefin mist suppressant. Oil-soluble copolymers of ethylene and $C_{3-12}$ mono-olefins and having average molecular weights greater than 5,000 are particularly useful additives. In addition to the use of petroleum-derived base oils, hydrocarbon base oils such as alkyl, aryl, and alkaryl phosphate esters, alkyl benzenes, polyoxyalkylene esters or glycols, ortho silicates and siloxanes and also indicated to be useful for the formulation of mist oil compositions employed for the process.

Butene polymers are also utilized to obtain other lubricant compositions. For example, in U.S. Pat. No. 3,098,042 lubricant fluids and greases derived from either mineral or synthetic oils and containing a polymer of butene-1 having a molecular weight in the range 10,000 to 20,000 are disclosed. Various synthetic esters derived from mono- and/or dibasic acids and mono- or polyfunctional alcohols are disclosed as being useful for the preparation of these lubricants. The polybutene-1 can be utilized in an amount from about 0.5 to 12 weight percent. Conventional grease thickeners, such as salts and soaps of fatty acids, may also be present in the composition. Synthetic lubricants with good shear stability and cold temperature fluidity containing 10% to 95% diester with 90% to 5% of a polymer of butene are described in U.S. Pat. No. 3,860,522. The diesters are obtained from branched-chain dicarboxylic acids having from 16 to 22 carbon atoms and aliphatic alcohols having fewer than 6 carbon atoms. The butene polymers have molecular weights from about 1,200 to 4,500. Neither of the above compositions, however, is utilized for oil mist applications.

It would be highly useful if a process were available whereby superior lubrication and misting properties are obtained. It would be particularly advantageous if the process utilized readily available synthetic ester basestocks.

SUMMARY OF THE INVENTION

We have now quite unexpectedly discovered an improved process which utilizes mist lubricant compositions comprised of certain relatively high viscosity synthetic esters and a mixture of isobutylene polymers having different molecular weights. Synthetic esters which are employed in the process are polyol esters, trimellitate esters, and polymeric fatty acid esters having 40° C. viscosities in the range 15 to 300 centistokes. Two different polyisobutylene polymers are necessarily employed—one having an average molecular weight from 4,000 to 10,000 and the other having an average molecular weight from 25,000 to 300,000.

With the present improved mist lubricant process, it is possible to efficiently generate acceptable mists over a wide range of operating temperatures. This feature makes it possible to obtain significantly increased throughputs. Additionally, by the process of this invention a significant improvement (15–20%) in bearing life is obtained over bearings lubricated with petroleum-based mist oils.

For the process, a lubricant is generated in air maintained at a temperature of 100° F. to 225° F. and pressure of 10 to 100 psig, pneumatically transported to a metal surface to be lubricated, coalesced into larger droplets, and deposited on the metal surface to provide a lubricating film thereon. The mist lubricant employed for the present improved process is comprised of (1) 45 to 95 parts by weight synthetic ester selected from the group consisting of (a) polyol esters derived from an aliphatic polyol having from 2 to 8 hydroxyl groups and 3 to 12 carbon atoms and an aliphatic monocarboxylic acid or mixture of aliphatic monocarboxylic acids having from 5 to 20 carbon atoms; (b) trimellitate esters derived from trimellitic acid or trimellitic anhydride and an aliphatic alcohol having from 8 to 16 carbon atoms; and (c) polymeric fatty acid esters derived from a polymeric fatty acid containing 75% or more $C_{36}$ dimer acid and a $C_{1-13}$ mono-functional alcohol; (2) 8 to 40 parts by weight, on a 100 percent polymer basis, polyisobutylene having an average molecular weight from 4,000 to 10,000; and (3) 0.1 to 1 part by weight, on a 100% polymer basis, isobutylene polymer having an average molecular weight from 25,000 to 300,000, is employed. The compositions typically have 40° C. viscosities of 125 to 750 centistokes and, more generally, 175 to 550 centistokes. Especially advantageous mist oil compositions contain 55 to 85 parts by weight synthetic ester, 12 to 30 parts by weight polyisobutylene having a weight average molecular weight of 4,500 to 8,500, and 0.25 to 0.85 part by weight polyisobutylene having an average molecular weight from 50,000 to 200,000. Minor amounts of petroleum diluent(s) and effective amounts of conventional lubricant additives may also be present.

DETAILED DESCRIPTION OF THE INVENTION

Excellent lubrication and misting properties are obtained with the improved lubrication process of this invention whereby oil mist lubricants comprised of specific synthetic esters of relatively high viscosity, a first polyisobutylene polymer of relatively low molecular weight, and a second polyisobutylene polymer having a significantly higher average molecular weight than said first polyisobutylene, are utilized. The ester and polyisobutylene polymers are employed in specified ratios in order to achieve the desired balance of mist characteristics and lubricating properties. The present lubrication process finds particular advantage for the lubrication of roll bearings in hot strip mills.

Mist lubrication processes are well known and numerous mist lubrication systems as well as operating conditions therefor are described in the literature. In general terms, mist lubrication processes involve generating an oil mist, also sometimes referred to as a microfog or aerosol, and pneumatically transporting said mist in air or other inert gas to the point(s) requiring lubrication. The mist is passed through a reclassifier, an orifice which causes the very small oil droplets to coalesce or condense into larger droplets, before being directed onto the object being lubricated.

Mist generators are used to form the oil mists. Generally these generators consist of a reservoir for the lubricant which is connected to a venturi by means of an oil lift (siphon) tube. As compressed gas, usually air, is passed through the venturi the lubricant is drawn from the reservoir and, as it is intimately mixed with the air, formed into droplets. The air/droplet mixture is then contacted in the generator with a baffle which causes the larger droplets to condense and the condensate is returned to the oil reservoir. The smaller oil droplets, generally having diameters of 3 microns or less, remain dispersed in the air and are pneumatically transported through manifold distribution lines to the point of lubrication.

The amount and nature of the mist formed can be varied by changing the temperature of the air and the air pressure (velocity). Pressures between 10 psig and 100 psig and, more preferably, from 20 psig to 80 psig are employed. Air temperature will generally range from 100° F. to 225° F. It is especially advantageous if the air temperature is maintained between 125° F. and 200° F.

The mist distribution system is designed to carry the oil/air dispersion to the point of lubrication with minimal condensation. Accordingly, the length of the lines should not be too long and care must be exercised in its design. For example, the number of bends in the line should be kept to a minimum and sharp bends should be avoided. Also, there should be no low points in the line where condensate can collect and create a blockage. Distribution lines are generally sloped, either toward the generator or toward the point of lubrication, to avoid collection of condensate. Drain legs are provided as necessary. Auxiliary lines generally come off of the top of the main distribution line. In general, the design requirements for the auxiliary lines are the same as for the main manifold or header.

The oil/air dispersion is passed through a reclassifier (orifice) to convert (coalesce) the small oil droplets into larger droplets and increase the velocity of the oil/air dispersion—both of which insure maximum wetting of the surface to be lubricated. The size and type of the reclassifier will vary depending on the particular application involved and the oil/air dispersion characteristics.

In these processes, the amount of lubricant which is processed, i.e., misted, is referred to as "throughput." Throughput is expressed as a unit of weight or volume per unit of time, e.g., grams/hour, and is further broken down into the following three components: (a) dropout, (b) reclassified oil, and (c) stray mist. Dropout is the amount of mist which is condensed in the lines and never reaches the reclassifier. Mist which is condensed in the distribution lines may be returned to the mist generator and remisted. Reclassified oil is the actual amount of lubricant which is applied to the surface being lubricated. Mist which is not applied to the surface being lubricated but rather escapes into the atmosphere is referred to as stray mist or stray fog. Since throughput is equal to (a)+(b)+(c), stray mist is obtained by determining the difference between the throughput and the sum of (a) and (b). Dropout, reclassified oil, and stray mist are often reported as a percent of throughput or can be represented as a ratio.

From the foregoing, it is evident that even though high throughput can be achieved in a particular process, the distribution of mist components may render the process unuseable or uneconomical. For example, excessive amounts of line condensate (dropout) or excessive amounts of stray mist can result in inadequate delivery of lubricant at the point of lubrication. Stray mist is particularly troublesome since this is lubricant which is lost. This not only creates a hardship from an economic standpoint but it also presents a health and safety hazard. Thus, in developing an acceptable mist lubrication process and selecting a mist oil for such system, the distribution of mist components (a), (b) and (c) must be taken into consideration along with the throughput.

Additionally, acceptable lubrication must be obtained with the process in order to have a completely acceptable oil mist system. This requires that the mist oil, in addition to having good mist properties, also exhibit good lubricity, oxidation stability, antiwear and extreme pressure properties, antirust/anticorrosion properties, and possibly other characteristics dependent upon the particular application involved. The lubricant must also be essentially free from undesirable waxes. Waxes can build up in the reclassifier heads and cause restriction or complete blockage thereof. In either event, insufficient lubricant will be delivered to the point of lubrication and, in the case of bearings, can substantially shorten the life of the bearing.

The lubricant must also exhibit good wettability or spreadability on the surface(s) to which it is applied. One of the problems most frequently encountered with mist lubrication process for large bearings, such as those utilized on rolling mills, is lack of uniformity of lubricant distribution over all bearing and roll neck surfaces. This lack of adequate lubricant film results in excessive localized wear and premature bearing failure. "Dry neck" or areas of insufficient lubrication on the roll neck are frequently observed upon disassembly of mist oil lubricated roll bearings. Processes wherein all of the bearing and roll neck surfaces are uniformly coated with the mist lubricant significantly prolong bearing life and reduce operating costs.

With the process of this invention, effective amounts of oil mist are readily produced while obtaining good oil mist distribution, i.e., low stray mist and low line condensate. Also, high throughputs are possible over a wide range of operating temperatures and pressures and undesirable wax deposits are minimized, and in most cases, completely eliminated. Additionally, and quite unexpectedly, improved wettability and spreadability of the mist oil lubricant is obtained so that, when used to lubricate rolling mill bearings, a uniform continuous film of lubricant is deposited on the bearing and roll neck.

The foregoing improvements are obtained with the process of this invention which utilizes a mist lubricant composition containing a synthetic ester and a mixture of two polyisobutylene polymers having different average molecular weights. The synthetic esters employed are relatively high viscosity polyol esters, trimellitate esters, or polymeric fatty acid esters. These esters have 40° C. viscosities in the range 25 to 300 centistokes. Particularly advantageous mist oil compositions for the process are obtained when the viscosity (40° C.) of the synthetic ester is between 50 and 250 centistokes.

Polyol esters which can be used are derived from aliphatic polyols having from 3 to 12 carbon atoms and 2 to 8 hydroxyl groups. More generally, the polyol will contain 5 to 8 carbon atoms and 2 to 4 hydroxyl groups. Illustrative aliphatic polyols of the above types include neopentyl glycol, 2,2-dimethyl-3-hydroxypropyl-2,2-dimethyl-3-hydroxypropionate, 2,2,4-trimethyl-1,5-pentanediol, trimethylolethane, trimethylolpropane, glycerol, pentaerythritol, dipentaerythritol, tripentaerythritol or the like. Technical pentaerythritol which contains mono, di-, tri- and higher pentaerythritols in varying proportions can also be used. Neopentyl glycol, trimethylolpropane and trimethylolethane are particularly useful. The polyols are reacted, partially or completely, with an aliphatic monocarboxylic acid or mixture of aliphatic monocarboxylic acids having from 5 to 20 carbon atoms. The $C_{5-20}$ aliphatic monocarboxylic acids can be branched or straight-chain and may be saturated or can contain unsaturation. They can be obtained from natural fats or oils or synthetically produced via oxo, Koch or other known reactions. Illustrative aliphatic monocarboxylic acids include valeric acid, isovaleric acid, caprylic acid, capric acid, lauric acid, myristic acid, palmitic acid, isopalmitic acid, stearic acid, isostearic acid, ricinoleic acid, oleic acid, linoleic acid, and mixtures thereof. Mixed acids derived from coconut oil, lard oil, tall oil, safflower oil, corn oil, tallow, soybean oil, palm oil, castor oil, rapeseed oil, and the like may also be utilized. Polyol esters obtained from the esterification of trimethylolpropane with $C_{12-18}$ aliphatic monocarboxylic acids or mixtures thereof, such as trimethylolpropane trioleate and trimethylolpropane triisostearate, are particularly useful for the preparation of the mist oil compositions used for the present process. The polyol esters typically have acid values less than 15 and hydroxyl values less than 100. More usually, acid and hydroxyl values of the polyol ester will be less than 8 and less than 25, respectively.

Useful trimellitate esters are obtained from trimellitic acid or trimellitic anhydride and aliphatic mono-functional alcohols having from 8 to 16 carbon atoms. Trimellitic acid and trimellitic anhydride are, of course, well known chemical products as are methods for their preparation. The aliphatic alcohols may be a straight-chain or branched primary, secondary, or tertiary alcohols. Illustrative alcohols include n-octyl alcohol, capryl alcohol, isooctanol, 2-ethylhexanol, decyl alcohol, isotridecyl and isodecyl alcohols, lauryl alcohol, myristyl alcohol, cetyl alcohol, and the like. Especially advantageous trimellitate esters are derived from $C_{10-13}$ aliphatic alcohols or alcohol mixtures. Isodecyl trimellitate, isotridecyl trimellitate and mixtures thereof, i.e., isodecyl/isotridecyl trimellitate, are particularly useful esters of this type. Acid values of these esters are generally less than 15 and, more preferably, less than 5. Hydroxyl values are typically less than 10 and, more preferably, less than 3.

The polymeric fatty acid esters are derived from polymeric fatty acids containing 75 percent or more $C_{36}$ dimer acid and $C_{1-13}$ mono-functional alcohols. Polymeric fatty acids are known as are methods for their manufacture. They are obtained by the polymerization of olefinically unsaturated monocarboxylic acids containing from about 16 to 20 carbon atoms, such as oleic acid, linoleic acid and the like. Processes for their production typically include: treatment of unsaturated fatty acid with acid catalysts such as HF, $BF_3$, and the like; thermal polymerization of unsaturated fatty acids conducted in the presence or absence of treated or untreated clay catalysts; and treatment of unsaturated fatty acids with peroxides. By way of illustration of the preparation of polymeric fatty acids, reference may be had to U.S. Pat. Nos. 2,793,219 and 2,955,121. Polymeric fatty acids from the polymerization of unsaturated fatty acids are primarily comprised of dimer and trimer acids; however, there may also be present in the mixture some higher acids and unreacted monomer.

$C_{36}$ polymeric fatty acids are obtained by the polymerization of $C_{18}$ unsaturated monocarboxylic acids, such as oleic acid and linoleic acid or mixtures thereof (e.g., tall oil fatty acids). These polymeric fatty acid products have as their principal components $C_{36}$ dimer and $C_{54}$ trimer acids. Excellent results are obtained with acids of this type which contain 75% by weight or more and $C_{36}$ dimer acid, the remainder of the product consisting essentially of $C_{54}$ trimer. High dimer content polymeric fatty acids containing substantially reduced amounts of higher polymer acids and unreacted unsaturated monocarboxylic acid can be obtained by molecular distillation or by the use of other highly efficient distillation procedures. The polymeric fatty acid may also be hydrogenated prior to use. Polymeric fatty acids of this type are commercially available products sold under the trademark Empol ® Dimer Acids.

Useful alcohols for the preparation of the polymeric fatty acid esters are aliphatic branched- or straight-chain, mono-functional alcohols having from 1 to 13 carbons. Representative mono-alcohols include methanol, ethyl alcohol, isopropyl alcohol, n-butyl alcohol, isobutyl alcohol, isoamyl alcohol, neopentyl alcohol, n-hexyl alcohol, n-octyl alcohol, 2-ethylhexanol, decyl alcohol, isodecyl alcohol, isotridecyl alcohol, lauryl alcohol, and the like. Minor amounts of polyfunctional alcohols such as ethylene glycol, 1,2- or 1,3-propanediol, 1,3-, 1,4- or 2,3-butanediol, 2,2,4-trimethyl-1,5-pentanediol, 1,6-hexanediol, neopentyl glycol, glycerol, trimethylolpropane, trimethylolethane, pentaerythritol, dipentaerythritol, tripentaerythritol, and the like may also be present with the monofunctional alcohol(s). Particularly advantageous polymeric fatty acid esters are obtained from polymeric fatty acids containing 85% or more $C_{36}$ dimer acid and $C_{8-10}$ aliphatic mono alcohols. Diisodecyl dimerate and di-2-ethylhexyl dimerate are especially advantageous. The polymeric fatty acid esters generally have acid values less than 100 and, more usually, less than 10. Hydroxyl values are generally less than 10 and, more preferably, less than 3.

A mixture of isobutylene polymers of different average molecular weights are necessarily employed with the above-identified synthetic esters to obtain the mist oil compositions used for the present improved process. Typically, two polyisobutylenes are utilized—the first, referred to herein as the low molecular weight polyisobutylene, has an average molecular weight from 4,000 to 10,000, and the second, referred to herein as the high molecular weight polyisobutylene, has an average molecular weight from 25,000 to 300,000. Molecular weights referred to herein are weight average molecular weights ($\overline{M}_w$). Small amounts of other butylene polymers not falling within the above-identified molecular weight ranges may also be present. Particularly useful mist oil compositions of this invention are obtained when the low molecular weight polyisobutylene has an average molecular weight of 4,500 to 8,500 and the high molecular weight polyisobutylene has an average molecular weight of 50,000 to 200,000.

The isobutylene polymers essentially conform to the formula

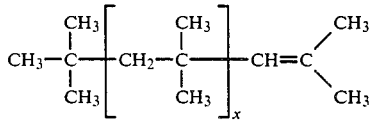

where x is an integer representing the number of repeating units. Polymers of the above types are known and widely utilized throughout the industry. They are obtained by polymerizing isobutylene feeds which usually contain minor amounts of butene-1 and/or butene-2. When the term polyisobutylene or isobutylene polymer is used herein, it is intended to encompass the aforementioned types of polymers.

The isobutylene polymers are obtained using known conventional polymerization techniques. The polymerization may be carried out in an inert hydrocarbon in which case a polymer solution containing from about 30 to 80 percent polyisobutylene will be obtained. If desired, diluent may also be added to the polymer when the polymerization is complete. Isobutylene polymer solutions may be utilized in the formulation of the mist oils. This can facilitate handling and blending of the polyisobutylene with the synthetic ester. All parts and percentages recited herein for the polyisobutylenes are, however, calculated on a 100% polymer basis. Inert hydrocarbon present in the mist oil composition as a result of the use of an isobutylene polymer solution does not detract from the overall misting and lubrication characteristics of the products.

Useful mist oil compositions for the process contain 45 to 95 parts by weight synthetic ester, 8 to 40 parts by weight, on a 100 percent polymer basis, low molecular weight polyisobutylene, and 0.1 to 1 part by weight, on a 100 percent polymer basis, high molecular weight polyisobutylene. More preferably, the mist oil compositions contain 55 to 85 parts synthetic ester, 12 to 30 parts by weight low molecular weight polyisobutylene and 0.25 to 0.85 part by weight high molecular weight polyisobutylene.

Especially useful ISO 220, 320, and 460 mist oil lubricants, the grades most widely used in the industry for lubrication of bearings in hot strip mills, which provide excellent mist and lubrication properties in the present process are obtained by combining 63 to 78 parts di-2-ethylhexyldimerate (40° C. viscosity 91 centistokes; viscosity index 155; pour point −50° F.; acid value <3; and hydroxyl value ≦2), 14 to 28 parts polyisobutylene having a number average molecular weight of about 7,500–7,600) and 0.33 to 0.66 part polyisobutylene having a number average molecular weight of about 89,000–90,000). Compositions and typical characteristics of 220, 320, and 460 ISO grade products, formulated with effective levels of additives are as follows:

| | ISO 220 | ISO 320 | ISO 460 |
|---|---|---|---|
| COMPOSITION (PARTS BY WEIGHT) | | | |
| Di-2-ethylhexyldimerate | 78 | 71 | 63 |
| Polyisobutylene ($\overline{M}_w$ 7,500–7,600) | 14 | 21 | 28 |
| Polyisobutylene ($\overline{M}_w$ 89,000–90,000) | 0.66 | 0.50 | 0.33 |
| TYPICAL CHARACTERISTICS | | | |
| Viscosity (ASTM-D-445) | | | |
| 40° C., cSt. | 219 | 316 | 466 |
| 100° C., cSt. | 26 | 33 | 44 |
| Viscosity Index (ASTM-D-2270) | 149 | 147 | 148 |
| Total Acid Number (ASTM-D-974) (mg KOH/gm) | 2.1 | 1.9 | 2.5 |
| Specific Gravity, 60/60° F. (ASTM-D-1298) | 0.902 | 0.904 | 0.900 |
| Flash Point, °F. (ASTM-D-92) | 430 | 420 | 415 |
| Pour Point, °F. (ASTM-D-97) | −40 | −25 | −20 |

One or more additives is commonly included in the mist oil formulation employed for this process. Conventional additives are used and typically include antioxidants, antiwear/EP agents, rust and corrosion inhibitors, metal deactivators, foam inhibitors, demulsifiers, and the like. Many of these additives have overlapping functions, i.e., be multifunctional. For example, certain additives may impart both antiwear and extreme pressure properties or function both as a metal deactivator and a corrosion inhibitor. Cumulatively, these additives typically do not exceed 8 percent and, more usually 5 percent, of the mist oil formulation.

Oxidation inhibitors which can be employed include the phenolic antioxidants derived from t-butylphenol, such as 4,4'-methylenebis(2,6-di-t-butylphenol), 2,6-di-t-butyl-N,N-dimethylamino-p-cresol, and thiodiethylenebis(3,5-di-t-butyl-4-hydroxy)hydrocinnamate, and the like; arylamines including N,N'-diphenyl phenylenediamine; diphenyl amines such as p-octyldiphenyl amine, p,p'-dioctyldiphenyl amine and the like, N-phenylnaphthylamines such as N-phenyl-1-naphthylamine, N-phenyl-2-naphthylamine, N-(p-dodecylphenyl)-2-naphthlamine and the like; dinaphthylamines such as di-1-naphthylamine, di-2-naphthylamine and the like; phenothiazines, such as N-alkyl phenothiazine; dithiocarbamate derivatives; etc. From 0.5 to about 1.5 part antioxidant is generally employed.

Generally about 0.3 to 2 parts of an antiwear agent and 1 to 2 parts of an extreme pressure (EP) agent are included in the mist oil. Illustrative agents of these types include: sulfurized fatty acid and fatty acid esters, such as sulfurized isooctyl tallate; sulfurized terpenes; sulfurized olefins; organopolysulfides; organophosphorous derivatives including amine phosphates, alkyl acid phosphates, dialkyl phosphates, aminedithiophosphates, trialkyl or triaryl phosphorothionates, trialkyl and triaryl phosphines, dialkyl phosphites, e.g., triphenyl phosphate, trinaphthyl phosphate, tricresyl phosphate, diphenyl cresyl or dicresyl phenyl phosphate, naphthyl diphenyl phosphate, triphenyl phosphorothionate; dithiocarbamates, such as an antimony dialkyldithiocarbamates; xanthates; and the like.

Metal deactivators (passivators) and rust/corrosion inhibitors include dibasic acids, such as azelaic acid; propyl gallate; quinolines; quinones and anthraquinones; benzotriazole derivatives, such as tolyltriazole; benzoquanamine; aminoindazole; metal alkyl sulfonates, such as barium dinonyl naphthalene sulfonate; ester and amide derivatives of alkenyl succinic anhydrides (or acids); and the like. From 0.02 to 0.2 parts additives of these types are generally used.

Small amounts, most usually 0.005 to 0.05 part of an antifoam agent, can also be present including silicone oils, acrylates and other conventional products known to suppress foaming. Also, it may be advantageous to include a small amount, usually 0.001 to 0.05 part, of a demulsifying agent. Known demulsifiers can be employed for this purpose, such as metal alkyl sulfonates, alkylated phenols, alkoxylated alkylphenols, monohydric alcohols, alkylene glycols, and the like.

It is also possible, and often advantageous, to utilize the so-called "multipurpose" or "universal" additive packages which are available from additive manufacturers for the formulation of the mist oils used for the present process. These are sold under various trademarks and tradenames, such as "Elco 345," "Hitec 323," "Lubrizol 5034," and the like. These additive packages typically impart good oxidation stability, antiwear and extreme pressure properties to the formulated fluid. When the additive package is utilized in low concentrations, however, it may be necessary to add additional corrosion inhibitor and defoamant.

The following examples illustrate the various embodiments of the invention more fully. All parts and percentages are on a weight basis unless otherwise indicated. Molecular weights reported throughout were determined by gel permeation chromatography using a Waters Associates HPLC Model 204 instrument fitted with a differential refractive index detector (Model R401). The detector was set at an attenuation of 16. Ultrastyragel® columns of $10^4$, $10^3$, 500 and 100Å connected in series and maintained at 35°±0.1° C. were used. Tetrahydrofuran, at a flow rate of 1.0 milliliter per minute, was used as the eluting solvent. Samples were dissolved in tetrahydrofuran (50 mg/ml THF) and a 50 microliter aliquot injected for each determination. Ten polystyrene resins of known molecular weight (ranging from 240,000 to 601) were employed as the standards for the determinations. Mist properties were determined in accordance with the general procedure of ASTM D 3705-78. For the tests, the temperature of the oil was maintained at 120° F. Air temperatures used for the determinations were 150° F., 175° F. or 200° F.

EXAMPLE I

An ester-based mist oil composition was prepared and used in a hot strip mill to lubricate bearings (19 inch I.D. double roller type) on the rolls of a rotary forger. The mist lubricant was obtained by blending 63.1 parts di-2-ethylhexyl dimerate (40° C. viscosity 91 centistokes; viscosity index 155; pour point −50° F.; acid value <3, and hydroxyl value ≦2) with 27.5 parts isobutylene polymer of $\overline{M}_w$ 7573 and 0.33 part isobutylene polymer of $\overline{M}_w$ 89,793. Blending was carried out at 90° C. and the polyisobutylenes were dissolved in inert hydrocarbons before combining with the ester. The resulting blend was cooled to approximately 60° C. and 3.5 parts of a commercial ashless multipurpose gear oil additive (Elco® 345) added with agitation. The mist lubricant (ISO grade 460) had the following properties:

| Viscosity (ASTM-D-445) | |
|---|---|
| 40° C., cSt. | 466 |
| 100° C., cSt. | 44 |
| Viscosity Index (ASTM-D-2270) | 148 |
| Total Acid Number (ASTM-D-974) (mg KOH/gm) | 2.5 |
| Specific Gravity, 60/60° F. (ASTM-D-1298) | 0.900 |
| Flash Point, °F. (ASTM-D-92) | 415 |
| Pour Point, °F. (ASTM-D-97) | −20 |

Mist characteristics were determined at 175° F. and 200° F. and were as follows:

| | 175° F. | 200° F. |
|---|---|---|
| Oil Output (grams/hour) | 32.8 | 39.6 |
| Percent Reclassified Oil | 76.9 | 77.5 |
| Percent Line Condensate | 12.1 | 11.4 |
| Percent Stray Mist | 11.0 | 11.1 |

It is apparent from the data that minimal dropout and very low stray mist was obtained while maintaining high throughputs. While comparable throughputs can be obtained with commercially available mineral oil-based mist lubricants, under the operating conditions necessary to generate such throughputs, significant wax deposits which restrict the delivery of the mist lubricant and, in some cases, cause complete blockage of the reclassifier head are obtained upon extended periods of operation. No wax buildup was obtained with the above-formulated synthetic ester mist lubricant and it was possible to continuously operate the system without changing the mist distribution or significantly adjusting the operating conditions.

The ester-based lubricant was employed in a hot strip mill for the mist lubrication of roll bearings. The ester-based lubricant was misted in air (70–80 psig; 170–200° F.) using a commercial mist generator having a sump of 2–3 gallons. The oil was heated to approximately 100° F. in the sump. Mist was drawn from the generator by $2\frac{1}{2}$ inch lines and transported through the manifold to the reclassifiers. Conventional reclassifier heads containing 9 0.067" holes were employed. Excellent misting was observed and no restriction or clogging of the reclassifier heads was noted. Additionally, superior lubrication was obtained. Fifteen to twenty percent increase in tonnage per bearing was obtained with the above-formulated synthetic ester lubricant compared to the commercial mineral oil-based mist lubricant which was previously used in the mill. Additionally, during routine maintenance and servicing (which is regularly performed after processing 150,000 tons), "dry neck" (areas of insufficient lubrication) was virtually eliminated on the roll necks lubricated in accordance with the process of this invention using the ester-based mist oil composition. "Dry neck" was observed in almost every case on the outside portion of the roll neck where the bearing is seated with the petroleum-based mist lubricants.

Over a period of ten weeks of plant operation, thirty bearings were lubricated with the above-formulated synthetic ester ISO 460 mist lubricant and an equal number of bearings were lubricated using a commercial ISO 460 petroleum-based mist lubricant. All of the bearings were in the same mill line so that both groups of bearings were evaluated under comparable operating conditions, i.e., had essentially the same work histories. Also, essentially the same amount of lubricant was applied to both sets of bearings. During the period, only one bearing lubricated with the ester-based mist oil "burned-up," i.e., the bearing became mechanically frozen. On the other hand, 12 of the bearings lubricated with the petroleum-based mist oil were "burned-up." Upon routine examination at the regular maintenance intervals, an additional eight bearings from the latter group were judged to be damaged and had to be scrapped. None of the bearings lubricated with the synthetic ester lubricants were observed to be damaged upon inspection during these regular maintenance checks. Cost savings realized using the ester-based mist oil, including bearing and roll usage and the cost of the oil, was calculated to be over $10,000 per week.

EXAMPLE II

To demonstrate the criticality of the lubricant composition for the process and the need to utilize a mixture of lower and higher molecular weight isobutylene polymers, three ISO 460 grade mist oil compositions were prepared following the procedure of Example I. The lubricant compositions prepared were as follows:

| | IIA | IIB | IIC |
|---|---|---|---|
| Di-2-ethylhexyl Dimerate | 63.1 | 62.5 | 63.1 |
| Polyisobutylene ($\overline{M}_w$ 7573) | 27.5 | — | 28.4 |
| Polyisobutylene ($\overline{M}_w$ 89,793) | 0.33 | 11.2 | — |
| Additive | 3.5 | 3.5 | 3.5 |

Mist properties were determined at 150° F. for each of the above ISO 460 formulations with the following results:

| | IIA | IIB | IIC |
|---|---|---|---|
| Oil Output (grams/hour) | 31.8 | 4.1 | 38.7 |
| Percent Reclassified Oil | 74.4 | 68.3 | 71.4 |
| Percent Line Condensate | 10.8 | 6.3 | 6.3 |
| Percent Stray Mist | 14.8 | 25.3 | 22.3 |

It is apparent from the above data that formulations IIB and IIC have unacceptably high levels of stray mist. Stray mist is generally considered to be acceptable if it is 15% or less. In no event can stray mist above 20% be tolerated. Additionally, the throughput obtained with product IIB was unacceptable. Only product IIA, wherein the ester was combined with both a high and low molecular weight polyisobutylene, gave both acceptable throughput and acceptable mist characteristics and were suitable for use in the lubrication of roll bearings.

EXAMPLE III

To further demonstrate the criticality of the molecular weight of the polyisobutylene used for the formulation of the ester-based mist lubricants used in the process, the following comparative example is provided. For this example, a mist oil formulation based on di-2-ethylhexyl dimerate and isobutylene polymers within the prescribed molecular weight range was prepared and compared with formulations prepared using a polyisobutylene outside the specified molecular weight range. The average molecular weight of the combined polyisobutylenes, i.e., polymer blend, was the same in each formulation ($\overline{M}_w$ 8550). Each of the oils was also formulated to the same viscosity, i.e., ISO grade 460. The mist oil formulations were as follows:

| | IIIA | IIIB | IIIC |
|---|---|---|---|
| Di-2-ethylhexyl Dimerate | 63.1 | 60.0 | 34.5 |
| Polyisobutylene ($\overline{M}_w$ 7573) | 27.5 | — | — |
| Polyisobutylene ($\overline{M}_w$ 89,793) | 0.33 | — | 4.08 |
| Polyisobutylene ($\overline{M}_w$ 77,284) | — | 2.35 | — |
| Polyisobutylene ($\overline{M}_w$ 3199) | — | 30.2 | — |
| Polyisobutylene ($\overline{M}_w$ 1874) | — | — | 49.64 |
| Additive | 3.5 | 3.5 | 3.5 |

Mist properties were determined at 175° F. and the following results obtained:

| | IIIA | IIIB | IIIC |
|---|---|---|---|
| Oil Output (grams/hour) | 32.8 | 20.8 | 15.9 |
| Percent Reclassified Oil | 76.9 | 66.2 | 66.8 |
| Percent Line Condensate | 12.1 | 20.2 | 16.0 |
| Percent Stray Mist | 11.0 | 13.6 | 17.3 |

It is evident from the above data that products IIIB and IIIC which were formulated with an isobutylene polymer outside the specified molecular weight range have significantly lower throughputs than product IIIA. Products IIIB and IIIC are totally unsatisfactory as mist oils for the lubrication of bearings as a result of the low throughput and the high percentage of oil which is not delivered for lubrication, i.e., condensed in the line or permanently lost as stray mist. Only product IIIA, formulated in accordance with the present invention, had a throughput and balance of mist properties making it acceptable for use in mist systems for the lubrication of bearings.

EXAMPLE IV

To demonstrate the versatility of the present invention and the ability to utilize lower viscosity synthetic mist oils, a lubricant composition was formulated in accordance with the following recipe:

| | Parts |
|---|---|
| Di-2-ethylhexyl Dimerate | 77.5 |
| Polyisobutylene ($\overline{M}_w$ 7573) | 14.5 |
| Polyisobutylene ($\overline{M}_w$ 89,793) | 0.66 |
| Elco ® 345 Multipurpose Additive | 3.5 |

The mist oil composition had the following properties:

| | |
|---|---|
| Viscosity (ASTM-D-445) | |
| 40° C., cSt. | 219 |
| 100° C., cSt. | 26 |
| Viscosity Index (ASTM-D-2270) | 149 |
| Total Acid Number (ASTM-D-974) (mg KOH/gm) | 2.1 |
| Specific Gravity, 60/60° F. (ASTM-D-1298) | 0.902 |
| Flash Point, °F. (ASTM-D-92) | 430 |
| Pour Point, °F. (ASTM-D-97) | −40 |
| Mist Characteristics at 175° F.: | |
| Oil Output (grams/hour) | 52.4 |
| Percent Reclassified Oil | 75.7 |
| Percent Line Condensate | 13.1 |
| Percent Stray Mist | 11.4 |
| Mist Characteristics at 200° F.: | |
| Oil Output (grams/hour) | 63.6 |
| Percent Reclassified Oil | 74.4 |
| Percent Line Condensate | 11.4 |
| Percent Stray Mist | 14.2 |

The lubricant was an effective mist oil suitable for the lubrication of bearings. An effective mist oil having comparable properties is obtained when the formulation is prepared substituting 2 parts sulfurized isooctyl tallate, 1 part phenyl α-naphthylamine, 1 part tricresylphosphate, 0.05 part benzotriazole, 0.05 part dodecenylsuccinate half ester of ethylene glycol, 0.005 part Dow DC-200 polydimethylsiloxane, and 0.01 part propylene glycol for the commercial additive package.

EXAMPLE V

An ISO 320 mist oil composition suitable for lubricating bearing was obtained by blending the following ingredients:

| | |
|---|---|
| Di-2-ethylhexyl Dimerate | 70.7 |
| Polyisobutylene ($\overline{M}_w$ 7573) | 20.7 |
| Polyisobutylene ($\overline{M}_w$ 89,793) | 0.50 |
| Commercial Universal Additive Package (20.5% S; 1.1% P) | 3.5 |

Physical properties and mist characteristics of the resulting mist oil composition were as follows:

| | |
|---|---|
| Viscosity (ASTM-D-445) | |
| 40° C., cSt. | 316 |
| 100° C., cSt. | 33 |
| Viscosity Index (ASTM-D-2270) | 147 |
| Total Acid Number (ASTM-D-974) (mg KOH/gm) | 1.9 |
| Specific Gravity, 60/60° F. (ASTM-D-1298) | 0.904 |
| Flash Point, °F. (ASTM-D-92) | 420 |
| Pour Point, °F. (ASTM-D-97) | −25 |
| Mist Characteristics at 175° F.: | |
| Oil Output (grams/hour) | 41.7 |
| Percent Reclassified Oil | 75.5 |
| Percent Line Condensate | 13.9 |
| Percent Stray Mist | 10.5 |
| Mist Characteristics at 200° F.: | |
| Oil Output (grams/hour) | 55.0 |
| Percent Reclassified Oil | 74.5 |
| Percent Line Condensate | 11.8 |
| Percent Stray Mist | 13.8 |

EXAMPLE VI

To demonstrate the ability to use other synthetic esters, and ISO 460 mist lubricant was prepared using a blend of isotridecyl and isodecyl trimellitate. The mist oil composition was formulated in accordance with the usual procedure as follows: (40° C. viscosity 250 centistokes; acid value 0.02; hydroxyl value 1.8; pour point −20° F.)

| | Parts |
|---|---|
| Isotridecyl Trimellitate | 79.5 |
| Polyisobutylene ($\overline{M}_w$ 7573) | 14.0 |
| Polyisobutylene ($\overline{M}_w$ 89,793) | 0.17 |
| Additives | 3.5 |

Mist characteristics (175° F.) were as follows:

| | |
|---|---|
| Oil Output (grams/hour) | 34.9 |
| Percent Reclassified Oil | 74.5 |
| Percent Line Condensate | 14.5 |
| Percent Stray Mist | 11.0 |

The product exhibited good lubrication properties and is an effective lubricant for roll bearings in hot strip mills. It can also be used in mist systems for the lubrication of pump, turbine and motor bearings.

EXAMPLE VII

A mist oil composition based on trimethylolpropane triisostearate (40° C. viscosity 90 centistokes; acid value 5; hydroxyl value 10; pour point −15° F.) and suitable as a bearing lubricant was formulated as follows:

| | Parts |
|---|---|
| Trimethylolpropane Triisostearate | 68.5 |
| Polyisobutylene ($\overline{M}_w$ 7573) | 23.1 |
| Polyisobutylene ($\overline{M}_w$ 89,793) | 0.28 |
| Elco ® 345 | 3.5 |

The above-prepared lubricant composition had a 40° C. viscosity of 459 centistokes and 175° F. mist characteristics were as follows:

| | |
|---|---|
| Oil Output (grams/hour) | 31.7 |
| Percent Reclassified Oil | 73.9 |
| Percent Line Condensate | 15.5 |
| Percent Stray Mist | 10.6 |

Comparable mist and lubrication properties are obtained when the commercial additive is replaced with 4 parts antimony dialkyldithiocarbamate, 1 part tricresylphosphate, and 1 part barium dinonylnaphthalene sulfonate.

EXAMPLE VIII

An ISO 460 mist oil suitable for use in the process of this invention was prepared by blending 56.5 parts trimethylolpropane trioleate (40° C. viscosity 228 centistokes; acid value 4; hydroxyl value 4; pour point −50° F.) with 33.0 parts polyisobutylene ($M_w$ 7573) and 0.40 part polyisobutylene ($M_w$ 89,793). 3.5 Parts of a commercial "universal" additive package were also included in the formulation. The resulting blend had a 40° C. viscosity of 454 centistokes and exhibited superior lubrication and misting characteristics. Mist characteristics (175° F.) were as follows:

| | |
|---|---|
| Oil Output (grams/hour) | 29.2 |
| Percent Reclassified Oil | 71.8 |
| Percent Line Condensate | 16.4 |
| Percent Stray Mist | 11.8 |

The product is effective for the lubrication of roll bearings in hot strip mills. There was no evidence of wax buildup after extended periods of operation and visual inspection of the roll neck and bearing surfaces indicated good spreadability of the lubricant.

EXAMPLE IX

A series of ISO 460 mist oil compositions useful in the process were prepared using varying levels of the high and low molecular weight polyisobutylenes. Compositions were as follows:

| | IXA | IXB | IXC |
|---|---|---|---|
| Di-2-ethylhexyl Dimerate | 63.1 | 63.1 | 63.1 |
| Polyisobutylene ($\overline{M}_w$ 7573) | 25.8 | 27.1 | 28.0 |
| Polyisobutylene ($\overline{M}_w$ 89,793) | 0.99 | 0.50 | 0.17 |
| Additive | 3.5 | 3.5 | 3.5 |

Mist characteristics were determined at 175° F. (except for IXA) and 200° F. with the following results:

| | IXA | IXB | IXC |
|---|---|---|---|
| | Mist Characteristics at 175° F. | | |
| Oil Output (grams/hour) | NOT | 33.1 | 39.9 |
| Percent Reclassified Oil | TESTED | 77.9 | 76.7 |
| Percent Line Condensate | | 12.4 | 9.8 |
| Percent Stray Mist | | 9.7 | 13.5 |
| | Mist Characteristics at 200° F. | | |
| Oil Output (grams/hour) | 35.9 | 44.5 | 39.6 |
| Percent Reclassified Oil | 76.0 | 77.1 | 74.5 |
| Percent Line Condensate | 14.1 | 10.6 | 11.6 |
| Percent Stray Mist | 9.9 | 12.3 | 13.9 |

EXAMPLE X

A mist lubricant for the process was prepared following the general procedure of Example I except that the high molecular weight polyisobutylene used had an average molecular weight of 77,284. To obtain the composition, 63.1 parts di-2-ethylhexyl dimerate was blended with 27.5 parts polyisobutylene ($\overline{M}_w$ 7573) and 0.39 part of the high molecular weight isobutylene polymer. A commercially available "universal" additive package was also included in the blend at a 3.5 parts level. The resulting mist lubricant had a viscosity (40° C.) of 464 centistokes. Mist characteristics determined at 175° F. were as follows:

| | |
|---|---|
| Oil Output (grams/hour) | 32.0 |
| Percent Reclassified Oil | 72.7 |
| Percent Line Condensate | 14.8 |
| Percent Stray Mist | 12.4 |

The product also had lubrication properties comparable to the product of Example I and is effective for the mist lubrication of hot roll mill and other bearings.

We claim:

1. In a lubrication process wherein a mist of a lubricant is generated in air at a pressure of about 10 to 100 psig, pneumatically transported to a metal surface to be lubricated, coalesced into larger droplets, and deposited on said metal surface to provide a lubricating film thereon, to achieve high throughput with good mist distribution and to obtain good lubrication properties, the improvement which comprises utilizing a lubricant composition comprising:

(1) 45 to 95 parts by weight of a synthetic ester having a viscosity of 15 to 300 centistokes at 40° C. and selected from the group consisting of (a) polyol esters derived from an aliphatic polyol having from 2 to 8 hydroxyl groups and 3 to 12 carbon atoms and an aliphatic monocarboxylic acid or mixture of aliphatic monocarboxylic acids having from 5 to 20 carbon atoms;

(b) trimellitate esters derived from trimellitic acid or trimellitic anhydride and an aliphatic alcohol having from 8 to 16 carbon atoms; and (c) polymeric fatty acid esters derived from a polymeric fatty acid containing 75% or more $C_{36}$ dimer acid and a $C_{1-13}$ mono-functional alcohol;

(2) 8 to 40 parts by weight, on a 100% polymer basis, polyisobutylene having an average molecular weight from 4,000 to 10,000; and (3) 0.1 to 1 part by weight, on a 100% polymer basis, polyisobutylene having an average molecular weight from 25,000 to 300,000; and said composition having a viscosity of 125 to 750 centistokes at 40° C.

2. The process of claim 1 wherein the air temperature is 125° F. to 200° F. and air pressure is 20 psig to 80 psig.

3. The process of claim 1 wherein the lubricant contains up to 8 weight percent additives.

4. The process of claim 1 wherein the polyol ester (a) is derived from an aliphatic polyol having 5 to 8 carbon atoms and 2 to 4 hydroxyl groups and has an acid value less than 15 and hydroxyl value less than 100; the trimellitate ester (b) has an acid value less than 15 and hydroxyl value less than 10; and the polymeric fatty acid ester (c) has an acid value less than 100 and hydroxyl value less than 10.

5. The process of claim 4 wherein the polyisobutylene (2) has an average molecular weight of 4,500 to 8,500 and the polyisobutylene (3) has an average molecular weight of 50,000 to 200,000.

6. The process of claim 5 wherein the mist lubricant has a 40° C. viscosity of 175 to 550 centistokes and contains 55 to 85 parts (1), 12 to 30 parts (2), and 0.25 to 0.85 parts (3).

7. The process of claim 6 wherein (a) is derived from a polyol selected from the group neopentyl glycol, 2,2-dimethyl-3-hydroxypropyl-2,2-dimethyl-3-hydroxypropionate, 2,2,4-trimethyl-1,5-pentanediol, trimethylolethane, trimethylolpropane, glycerol, pentaerythritol, dipentaerythritol, tripentaerythritol and a $C_{12-18}$ aliphatic monocarboxylic acid or acid mixture; (b) is derived from trimellitic acid or trimellitic anhydride and a $C_{10-13}$ aliphatic alcohol or alcohol mixture; and (c) is derived from polymeric fatty acid containing 85% or more $C_{36}$ dimer acid and a $C_{8-10}$ aliphatic mono-alcohol or mono-alcohol mixture.

8. The process of claim 7 wherein (a) is trimethylolpropane trioleate or trimethylolpropane triisostearate, (b) is isodecyl trimellitate, isotridecyl trimellitate, or isodecyl/isotridecyl trimellitate, and (c) is diisodecyl dimerate or di-2-ethylhexyl dimerate.

9. A process for the lubrication of bearings which comprises generating a mist of lubricant in air at a temperature of 125° F. to 200° F. and pressure of 20 psig to 80 psig, said lubricant having a 40° C. viscosity of 175 to 550 centistokes and comprised of 45 to 85 parts by weight of a synthetic ester having a 40° C. viscosity of 50 to 250 centistokes and selected from the group consisting of trimethylolpropane trioleate and trimethylolpropane triisostearate, 8 to 40 parts by weight, on a 100 percent polymer basis, of a polyisobutylene having an average molecular weight from 4,000 to 10,000, 0.1 to 1 part by weight, on a 100 percent polymer basis, of a polyisobutylene having an average molecular weight from 25,000 to 300,000, 0.5 to 1.5 parts antioxidant, 0.3 to 2 parts antiwear agent, 1.0 to 2.0 parts extreme pressure agent, and 0.02 to 0.2 part metal deactivator or corrosion inhibitor; pneumatically transporting said mist to the bearing to be lubricated; coalescing said lubricant mist into larger droplets; and depositing said coalesced lubricant on said bearing to provide a continuous lubricating film thereon.

10. A process for the lubrication of bearings which comprises generating a mist of lubricant in air at a temperature of 125° F. to 200° F. and pressure of 20 psig to 80 psig, said lubricant having a 40° C. viscosity of 175 to 550 centistokes and comprised of 45 to 85 parts by weight of a synthetic ester having a 40° C. viscosity of 50 to 250 centistokes and selected from the group consisting of isodecyl trimellitate, isotridecyl trimellitate, and isodecyl/isotridecyl trimellitate, 8 to 40 parts by weight, on a 100 percent polymer basis, of a polyisobutylene having an average molecular weight from 4,000 to 10,000, 0.1 to 1 part by weight, on a 100 percent polymer basis, of a polyisobutylene having an average molecular weight from 25,000 to 300,000, 0.5 to 1.5 parts antioxidant, 0.3 to 2 parts antiwear agent, 1.0 to 2.0 parts extreme pressure agent, and 0.02 to 0.2 part metal deactivator or corrosion inhibitor; pneumatically transporting said mist to the bearing to be lubricated; coalescing said lubricant mist into larger droplets; and depositing said coalesced lubricant on said bearing to provide a continuous lubricating film thereon.

11. A process for the lubrication of bearings which comprises generating a mist of lubricant in air at a temperature of 125° F. to 200° F. and pressure of 20 psig to 80 psig, said lubricant having a 40° C. viscosity of 175 to 550 centistokes and comprised of 45 to 85 parts by weight of a synthetic ester having a 40° C. viscosity of 50 to 250 centistokes and selected from the group consisting of diisodecyl dimerate and di-2-ethylhexyl dimerate, 8 to 40 parts by weight, on a 100 percent polymer basis, of a polyisobutylene having an average molecular weight from 4,000 to 10,000, 0.1 to 1 part by weight, on a 100 percent polymer basis, of a polyisobutylene having an average molecular weight from 25,000 to 300,000, 0.5 to 1.5 parts antioxidant, 0.3 to 2 parts antiwear agent, 1.0 to 2.0 parts extreme pressure agent, and 0.02 to 0.2 part metal deactivator or corrosion inhibitor; pneumatically transporting said mist to the bearing to be lubricated; coalescing said lubricant mist into larger droplets; and depositing said coalesced lubricant on said bearing to provide a continuous lubricating film thereon.

12. A process for the lubrication of bearings which comprises generating a mist of lubricant in air at a temperature of 125° F. to 200° F. and pressure of 20 psig to 80 psig, said lubricant having a 40° C. viscosity of 175 to 550 centistokes comprised of 45 to 85 parts by weight of a synthetic ester having a 40° C. viscosity of 50 to 250 centistokes and selected from the group consisting of trimethylolpropane trioleate and trimethylolpropane triisostearate, 8 to 40 parts by weight, on a 100 percent polymer basis, of a polyisobutylene having an average molecular weight from 4,000 to 10,000, 0.1 to 1 part by weight, on a 100 percent polymer basis, of a polyisobutylene having an average molecular weight from 25,000 to 300,000, and up to 5 parts by weight of a multipurpose additive package; pneumatically transporting said mist to the bearing to be lubricated; coalescing said lubricant mist into larger droplets; and depositing said coalesced lubricant on said bearing to provide a continuous lubricating film thereon.

13. A process for the lubrication of bearings which comprises generating a mist of lubricant in air at a temperature of 125° F. to 200° F. and pressure of 20 psig to 80 psig, said lubricant having a 40° C. viscosity of 175 to 550 centistokes and comprised of 45 to 85 parts by weight of a synthetic ester having a 40° C. viscosity of 50 to 250 centistokes and selected from the group consisting of isodecyl trimellitate, isotridecyl trimellitate, and isodecyl/isotridecyl trimellitate, 8 to 40 parts by weight, on a 100 percent polymer basis, of a polyisobutylene having an average molecular weight from 4,000 to 10,000, 0.1 to 1 part by weight, on a 100 percent polymer basis, of a polyisobutylene having an average molecular weight from 25,000 to 300,000, and up to 5 parts by weight of a multipurpose additive package; pneumatically transporting said mist to the bearing to be lubricated; coalescing said lubricant mist into larger droplets; and depositing said coalesced lubricant on said bearing to provide a continuous lubricating film thereon.

14. A process for the lubrication of bearings which comprises generating a mist of lubricant in air at a temperature of 125° F. to 200° F. and pressure of 20 psig to 80 psig, said lubricant having a 40° C. viscosity of 175 to 550 centistokes and comprised of 45 to 85 parts by weight of a synthetic ester having a 40° C. viscosity of 50 to 250 centistokes and selected from the group consisting of diisodecyl dimerate and di-2-ethylhexyl dimerate, 8 to 40 parts by weight, on a 100 percent polymer basis, of a polyisobutylene having an average molecular weight from 4,000 to 10,000, 0.1 to 1 part by weight, on a 100 percent polymer basis, of a polyisobutylene having an average molecular weight from 25,000 to 300,000, and up to 5 parts by weight of a multipurpose additive package; pneumatically transporting said mist to the bearing to be lubricated; coalescing said lubricant mist to the bearing to be lubricated; coalescing said lubricant mist into larger droplets; and depositing said coalesced lubricant on said bearing to provide a continuous lubricating film thereon.

* * * * *